US005968346A

United States Patent [19]

Jung et al.

[11] Patent Number: 5,968,346

[45] Date of Patent: Oct. 19, 1999

[54] TWO STAGE HYDROPROCESSING WITH VAPOR-LIQUID INTERSTAGE CONTACTING FOR VAPOR HETEROATOM REMOVAL

[75] Inventors: Henry Jung, Chatham Borough; Ramesh Gupta, Berkeley Heights; Edward S. Ellis, Basking Ridge, all of N.J.; William E. Lewis, Baton Rouge, La.

[73] Assignee: Exxon Research and Engineering Co., Florham Park, N.J.

[21] Appl. No.: 09/153,921

[22] Filed: Sep. 16, 1998

[51] Int. Cl.[6] ..... C10G 45/02

[52] U.S. Cl. ..... 208/210; 208/211; 208/212; 208/218; 208/251 H; 208/254 H; 208/255; 208/263; 208/57; 208/58; 208/81; 208/82; 585/864; 585/867; 95/213; 95/233; 95/234; 95/235

[58] Field of Search ..... 208/210, 211, 208/212, 218, 251 H, 254 H, 255, 263, 57, 58, 81, 82, 103; 423/242.1, 242.2; 585/864, 867; 95/213, 232, 233, 234, 235

[56] References Cited

U.S. PATENT DOCUMENTS

| | | | |
|---|---|---|---|
| 2,952,626 | 9/1960 | Kelley et al. | 208/210 |
| 3,717,571 | 2/1973 | Schulman | 208/254 H |
| 3,919,402 | 11/1975 | Guth et al. | 423/522 |
| 4,021,330 | 5/1977 | Satchell, Jr. | 208/89 |
| 4,243,519 | 1/1981 | Schorfheide | 208/210 |
| 5,522,983 | 6/1996 | Cash et al. | 208/59 |

*Primary Examiner*—Walter D. Griffin
*Assistant Examiner*—Tung Doan
*Attorney, Agent, or Firm*—Henry E. Naylor

[57] ABSTRACT

A hydroprocessing process includes two hydroprocessing reaction stages, both of which produce a liquid and a vapor effluent, and a liquid-vapor contacting stage. The first stage vapor effluent contains impurities, such as heteroatom compounds, which are removed from the vapor by contact with processed liquid effluent derived from one or both reaction stages and, optionally, also liquid recovered from processed vapor. The first and contact stage liquid effluents are passed into the second stage to finish the hydoprocessing. The contact and second stage vapor effluents are cooled to recover additional hydroprocessed product liquid.

28 Claims, 2 Drawing Sheets

TWO STAGE HYDROPROCESSING WITH VAPOR-LIQUID INTERSTAGE CONTACTING FOR VAPOR HETEROATOM REMOVAL

FIELD OF THE INVENTION

The invention relates to hydroprocessing hydrocarbonaceous feeds using two hydroprocessing reaction stages, with interstage vapor-liquid contacting for vapor impurity removal. More particularly the invention relates to catalytically hydroprocessing a hydrocarbonaceous feed in two consecutive reaction stages, both of which produce a liquid and a vapor effluent. Impurities such as heteroatom (e.g., sulfur) components, are removed from the first stage vapor by contacting it with hydroprocessed liquid, which is then passed into the second stage for hydroprocessing and the impurity-reduced first stage vapor is combined with the second stage effluent, for product recovery.

BACKGROUND OF THE INVENTION

As supplies of lighter and cleaner feeds dwindle, the petroleum industry will need to rely more heavily on relatively high boiling feeds derived from such materials as coal, tar sands, shale oil, and heavy crudes, all of which typically contain significantly more undesirable components, especially from an environmental point of view. These components include halides, metals, unsaturates and heteroatoms such as sulfur, nitrogen, and oxygen. Furthermore, due to environmental concerns, specifications for fuels, lubricants, and chemical products, with respect to such undesirable components, are continually becoming tighter. Consequently, such feeds and product streams require more upgrading in order to reduce the content of such undesirable components and this increases the cost of the finished products.

In a hydroprocessing process, at least a portion of the heteroatom compounds are removed, the molecular structure of the feed is changed, or both occur by reacting the feed with hydrogen in the presence of a suitable hydroprocessing catalyst. Hydroprocessing includes hydrogenation, hydrocracking, hydrotreating, hydroisomerization and hydrodewaxing, and therefore plays an important role in upgrading petroleum streams to meet more stringent quality requirements. For example, there is an increasing demand for improved heteroatom removal, aromatic saturation and boiling point reduction. In order to achieve these goals more economically, various process configurations have been developed, including the use of multiple hydroprocessing stages as is disclosed, for example, in U.S. Pat. Nos. 2,952,626; 4,021,330; 4,243,519 and 5,522,983.

SUMMARY OF THE INVENTION

The invention relates to catalytically hydroprocessing a hydrocarbonaceous feed in two consecutive reaction stages, both of which produce a liquid and a vapor effluent. Impurities, such as heteroatom (e.g., sulfur) compounds or other undesirable feed components, are removed from the first stage vapor by contacting it with hydrocarbonaceous liquid, to transfer the impurities from the vapor into the liquid. After contacting, the vapor and liquid are separated, and the impurity-laden contacting liquid is passed into the second reaction stage, along with the first stage liquid effluent, for further hydroprocessing. The second stage effluent comprises hydroprocessed vapor and liquid which have an impurity level lower than that of the first stage effluents, with the second stage liquid effluent comprising hydroprocessed product liquid. The second stage and contacting stage vapor effluents, both of which have an impurity level lower than that of the feed and first stage effluents, are cooled to condense at least some of the hydrocarbonaceous material in the vapor to liquid. This liquid may be combined with the second stage liquid effluent, as hydroprocessed product liquid. The contacting is achieved in a countercurrent or crosscurrent flow contacting stage or zone in which the vapor flows up. The contacting zone comprises liquid-vapor contacting media. The hydrocarbonaceous contacting liquid is preferably liquid effluent produced by the process of the invention, that has been at least partially hydroprocessed, as is explained in more detail below. The first reaction stage is preferably a cocurrent gas and liquid flow stage, while the second reaction stage can be either a cocurrent or a countercurrent gas and liquid flow stage. In one embodiment, the contacting and second stage vapor effluents are combined and cooled to condense and recover the hydroprocessed hydrocarbonaceous material present in the vapors. In another embodiment, the contacting stage vapor effluent is combined with the second stage vapor and liquid effluents and the mixture sent to a separator, to separate the vapor from the hydroprocessed liquid. The separated vapors are then cooled to condense and separate the vaporized, hydroprocessed hydrocarbonaceous material as liquid, which is then combined, as additional product liquid, with the second stage liquid effluent. If desired, the impurity-reduced contacting stage vapor effluent may be processed separately from the second stage liquid effluent. Single or multiple stage cooling and liquid-vapor separation may be used. Using a liquid-vapor contacting stage or zone for removal of impurities or other components from the vapor, is significant in reducing the need for a third reaction stage, which would be a large vapor reaction stage, for removing the impurities from the first stage vapor effluent.

The first stage liquid and vapor effluents are in equilibrium with each other, with respect to the impurity level in each phase. Accordingly, therefore, by hydrocarbonaceous contacting liquid is meant a hydrocarbonaceous liquid which has an impurity level no greater, and preferably less, than that present in the first stage liquid effluent. If the impurity level of the contacting liquid is the same as that in the first stage liquid effluent, then the liquid is cooled prior to contact with the first stage vapor, in order to transfer impurities from the vapor into the liquid. Preferably the impurity level in the contacting liquid is less than that in the first stage liquid effluent and, more preferably, is also cooled to a temperature below that of the first stage vapor, prior to the contacting. This assures more efficient, and greater impurity transfer, from the vapor to the liquid. Typically, the contacting liquid will comprise either or both the first and second reaction stage liquid effluents. In the reaction stages, the hydrocarbonaceous feed is reacted with hydrogen in the presence of a suitable hydroprocessing catalyst at reaction conditions sufficient to achieve the desired hydroprocessing. The hydrogen is hydrogen gas, which may or may not be mixed or diluted with other gas and vapor components that do not adversely effect the reaction, products or process. If the hydrogen gas contains other such components, it is often referred to as hydrogen treat gas. If fresh hydrogen or substantially pure hydrogen is available, it is preferred that it be used at least in the second reaction stage. At least a portion, and more typically most (e.g., >50 wt. %) of the hydrocarbonaceous material being hydroprocessed in each stage is liquid at the reaction conditions. The hydroprocessing results in a portion of the liquid in each stage being converted to vapor. In most cases the hydrocarbonaceous material will comprise hydrocarbons.

In its broad sense, the invention comprises a hydroprocessing process for removing one or more impurities from a hydrocarbonaceous feed which comprises the steps of:

(a) reacting said feed with hydrogen in a first hydroprocessing reaction stage in the presence of a hydroprocessing catalyst to form a first stage effluent having a lower impurity content than said feed, said effluent comprising a first stage hydroprocessed hydrocarbonaceous liquid and a vapor which contains hydroprocessed hydrocarbonaceous feed components, wherein both said liquid and vapor effluents contain said impurities, with said impurities in equilibrium between said liquid and vapor effluents;

(b) separating said first stage liquid and vapor effluents;

(c) contacting said vapor effluent, in a contacting stage, with a hydrocarbonaceous liquid, under conditions such that impurities in said vapor transfer to said liquid, to form a contacting stage effluent comprising a hydrocarbonaceoous liquid of increased impurity content and a vapor comprising hydroprocessed hydrocarbonaceous feed components having an impurity content less than that of said first stage vapor effluent, and (d) reacting said first and contacting stage liquid effluents with hydrogen in a second hydroprocessing reaction stage, in the presence of a hydroprocessing catalyst, to form a second stage effluent comprising a hydroprocessed hydrocarbonaceoous liquid and a vapor comprising hydroprocessed hydrocarbonaceous feed components, wherein said liquid has an impurity content lower than that in said feed and first stage liquid effluent.

The second stage liquid effluent, which may require stripping, comprises hydroprocessed product liquid. If desired, with a cocurrent flow second reaction stage, combined liquid and vapor effluents may merely be passed to a separation zone, for separating the vapor and liquid phases without prior cooling. The separated vapor phase, which may be either all or a portion of (i) the second stage vapor or (ii) a combination of both the second and contacting stage vapors, is then cooled to condense a portion of the hydroprocessed vapors as liquid, which is then separated and recovered as additional hydroprocessed liquid. A specific example of this process is a hydrotreating process for removing heteroatom impurities, such as sulfur, nitrogen and oxygenate compounds, from feeds such as middle distillate fuel fractions, and heavier feeds. It being understood, however, that the invention is not limited to a hydrotreating process. This is explained in detail below. Further, and as a practical matter, the vapor effluent from each reaction stage will contain unreacted hydrogen.

DETAILED DESCRIPTION

Figure 1:
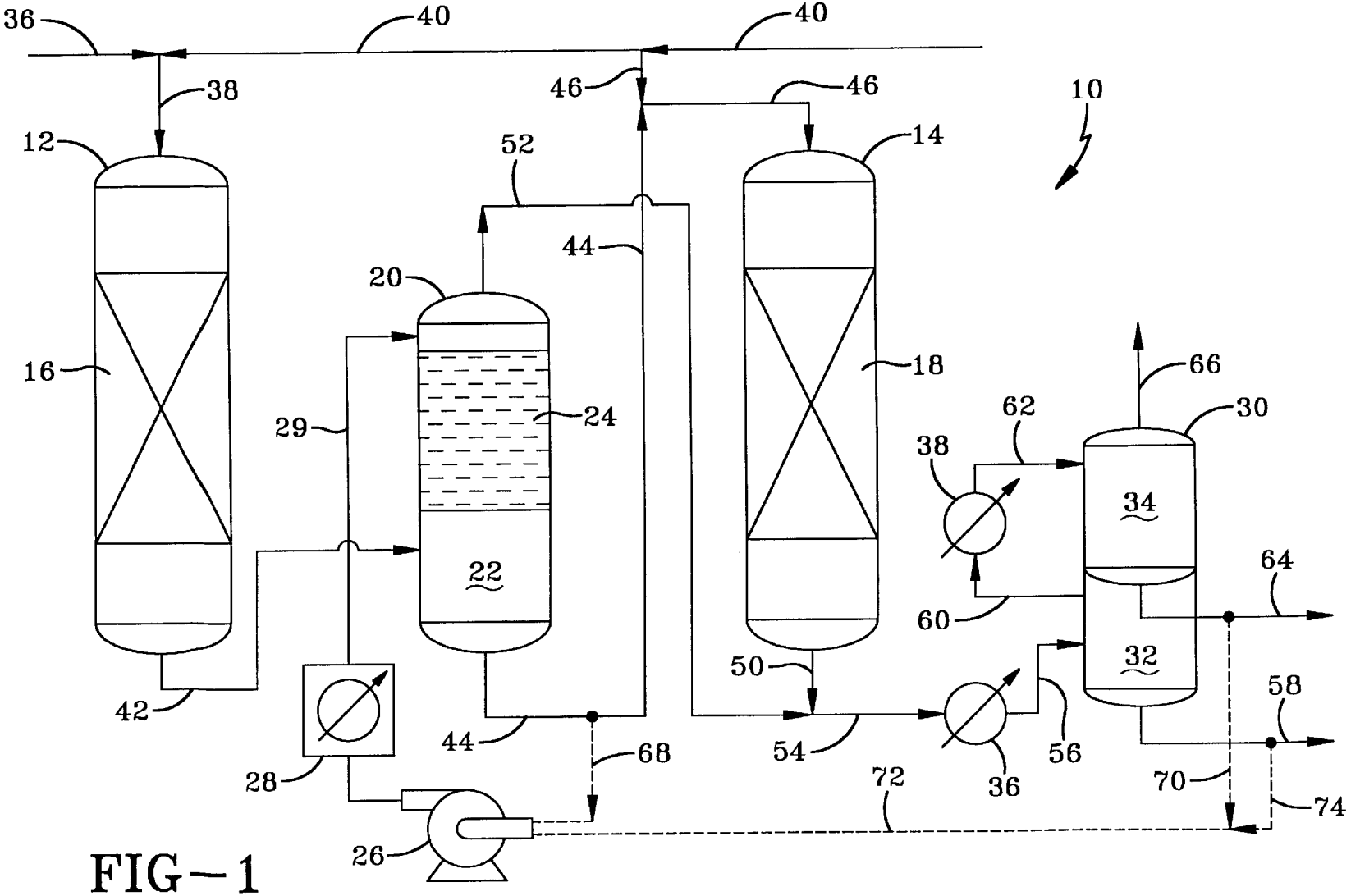
FIG. 1 schematically illustrates a flow diagram of an embodiment of the invention using cocurrent flow reaction stages, with the contacting stage in a separate vessel.

By hydroprocessing is meant a process in which hydrogen reacts with a hydrocarbonaceous feed to remove one or more impurities, to change or convert the molecular structure of at least a portion of the feed, or both. An illustrative, but non-limiting example of impurities may include (i) heteroatom impurities such as sulfur, nitrogen, and oxygen, (ii) ring compounds such as naphthenes, aromatics, condensed aromatics and other cyclic unsaturates, (iii) metals, (iv) other unsaturates, (v) waxy materials and the like. Thus, by impurity is meant any feed component which it is desired to remove from the feed by the hydroprocessing. Illustrative, but non-limiting examples of hydroprocessing processes which can be practiced by the present invention include forming lower boiling fractions from light and heavy feeds by hydrocracking; hydrogenating aromatics and other unsaturates; hydroisomerization and/or catalytic dewaxing of waxes and waxy feeds, and demetallation of heavy streams. Ring-opening, particularly of naphthenic rings, can also be considered a hydroprocessing process. By hydrocarbonaceous feed is meant a primarily hydrocarbon material obtained or derived from crude petroleum oil, from tar sands, from coal liquefaction, shale oil and hydrocarbon synthesis. The reaction stages used in the practice of the present invention are operated at suitable temperatures and pressures for the desired reaction. For example, typical hydroprocessing temperatures will range from about 40° C. to about 450° C. at pressures from about 50 psig to about 3,000 psig, preferably 50 to 2,500 psig. The first reaction stage vapor effluent may contain impurities or undesirable feed components, such as sulfur or other heteroatom compounds, which it is desired to remove from the first stage vapor. The hydrocarbonaceous contacting liquid will have an impurity concentration no greater, and preferably lower, than the impurity concentration in the first stage liquid effluent which is in equilibrium with the first stage vapor. While this contacting liquid may be any hydrocarbonaceous liquid which does not adversely affect either the process, or the desired hydroprocessed product liquid, and into which the vapor impurities will transfer, it will more typically comprise either or both the first and second reaction stage liquid effluents. Preferably it will be cooled to a temperature lower than the first stage vapor effluent, prior to the contacting. While a lower impurity concentration in the liquid will result in transfer of some impurities into it from the first stage vapor, having the contacting liquid at a temperature lower than that of the vapor, will result in transfer of more impurities, than if it was at the same temperature as the vapor.

Feeds suitable for use in such systems include those ranging from the naphtha boiling range to heavy feeds, such as gas oils and resids. Non-limiting examples of such feeds which can be used in the practice of the present invention include vacuum resid, atmospheric resid, vacuum gas oil (VGO), atmospheric gas oil (AGO), heavy atmospheric gas oil (HAGO), steam cracked gas oil (SCGO), deasphalted oil (DAO), light cat cycle oil (LCCO), natural and synthetic feeds derived from tar sands, shale oil, coal liquefaction, hydrocarbons synthesized from a mixture of $H_2$ and CO via a Fischer-Tropsch type of hydrocarbon synthesis, and mixtures thereof.

For purposes of hydroprocessing and in the context of the invention, the terms "fresh hydrogen" and "hydrogen-containing treat gas" are synonymous and may be either pure hydrogen or a hydrogen-containing treat gas which is a treat gas stream containing hydrogen in an amount at least sufficient for the intended reaction, plus other gas or gasses (e.g., nitrogen and light hydrocarbons such as methane) which will not adversely interfere with or affect either the reactions or the products. These terms exclude recycled vapor effluent from another stage which has not been processed to remove contaminants and at least a portion of any hydrocarbonaceous vapors present. They are meant to include either hydrogen or a hydrogen-containing gas from any convenient source, including the hydrogen-containing gas comprising unreacted hydrogen recovered from hydroprocessed vapor effluent, after first removing at least a portion and preferably most of the hydrocarbons (e.g., $C_{4+}$–$C_{5+}$) or hydrocarbonaceous material and any contaminants (e.g., $H_2S$ and $NH_3$) from the vapor, to produce a clean, hydrogen rich treat gas. The treat gas stream introduced into a reaction stage will preferably contain at least about 50 vol. %, more preferably at least about 75 vol. % hydrogen. In operations in which unreacted hydrogen in the vapor effluent of any particular stage is used for hydroprocessing in any stage, there must be sufficient hydrogen present in the fresh treat gas introduced into that stage for the vapor effluent of that stage, to contain sufficient hydrogen for the subsequent stage or stages.

The invention can be further understood with reference to the Figures. Thus, referring first to FIG. 1, there is depicted a schematic flow diagram of a hydroprocessing unit useful in the practice of the invention. In this particular embodiment the hydroprocessing process is a hydrotreating process and the reaction stages hydrotreating stages. For the sake of simplicity, not all process reaction vessel internals, valves, pumps, heat transfer devices etc. are shown. Thus, a hydrotreating unit 10 comprises first and second stage hydrotreating reaction vessels 12 and 14, containing respective fixed catalyst beds 16 and 18 within, for hydrotreating a distillate or diesel fuel feed. A third vessel 20, which is the liquid-vapor contacting stage vessel, contains a gas-liquid disengaging and separating zone 22 at the bottom and a bed of liquid-gas contacting material 24 in its upper portion, for the contacting stage. Also shown in this embodiment is a liquid transfer pump 26, an optional heat exchanger 28, a two stage separator vessel 30 with hot and cold separation zones 32 and 34, along with attendant heat exchangers 36 and 38 for cooling. The heteroatom-containing hydrocarbon feed to be hydrotreated, enters the first stage reaction vessel 12 via lines 36 and 38. In this particular illustration of the invention, the feed is a petroleum derived distillate or diesel fuel fraction containing heteroatom compounds of sulfur, nitrogen and perhaps oxygen. Fresh, once-through hydrogen or a treat gas comprising hydrogen enters via lines 40 and 38. The feed and hydrogen pass into vessel 12 and flow cocurrently down through the catalyst bed 16, which contains a sulfur tolerant catalyst, in which the feed reacts with the hydrogen in the presence of the catalyst to remove oxygenates, sulfur and nitrogen compounds present in the feed as $H_2S$ and $NH_3$, water, and saturate olefins and aromatics, to form a first stage effluent comprising a mixture of partially hydroprocessed hydrocarbon liquid and vapor, with the vapor containing vaporized feed components, unreacted hydrogen, $H_2S$ and $NH_3$. As those skilled in the art know, in hydrotreating and other hydroprocessing processes, the amount of hydrogen passed into a hydroprocessing reaction stage is in excess of that amount theoretically required to achieve the desired degree of conversion. This is done to maintain a sufficient hydrogen partial pressure throughout the reaction zone. Therefore, the vapor effluent from each hydroprocessing reaction zone will contain the unreacted hydrogen. Most (e.g., >50%) of the feed hydrotreating is accomplished in the first stage. In two stage hydrotreating processes, it is not unusual for 60%, 75% and even ≧90% of the heteroatom (S, N and O) compounds in the feed to be removed from the liquid in the first stage, by converting them to $H_2S$ $NH_3$, and $H_2O$. Therefore, the second stage catalyst can be a more kinetically active, but less sulfur tolerant catalyst than the first stage catalyst for heteroatom removal, and in addition can also achieve greater aromatics saturation. In this embodiment the first stage catalyst may comprise cobalt and molybdenum catalytic components supported on alumina, and the second stage catalyst may comprise nickel-molybdenum or nickel-tungsten catalytic metal components on an alumina support. The first stage liquid and vapor effluents are in equilibrium with respect to the impurity concentration in each phase and are removed from the bottom of vessel 12, and passed via line 42, into gas-liquid disengaging and separating zone 22, in the bottom of the contact stage vessel 20. The partially hydrotreated liquid separates from the vapor effluent, is removed from the bottom of the vessel and passed, via lines 44 and 46, into the top of the second stage reaction vessel 14. In this embodiment, the first reaction stage is operated at a higher pressure than the second reaction stage. Therefore a liquid transfer pump may not be required. The disengaged and separated first stage vapor passes up through the liquid-gas contacting bed means 24, in which it meets with downflowing hydrocarbon liquid that has been at least partially hydrotreated, and in which the concentration of the impurity compounds is no greater than, and preferably less, than that in the first stage liquid effluent in equilibrium with the first stage vapor effluent. Prior to contacting, the liquid is preferably cooled to a temperature lower than that of the first stage vapor in the contacting stage. The contacting means comprises any known liquid-vapor contacting means, such as rashig rings, berl saddles, wire mesh, ribbon, open honeycomb, gas-liquid contacting trays, such as bubble cap trays and other devices, etc. In the embodiment shown in the Figures, the dashed lines shown as the contacting means 24, represent gas-liquid contacting trays. Optional heat exchanger 28 cools the hydrocarbon liquid, if needed, to a temperature lower than that of the vapor. The liquid temperature is determined by the vapor temperature and the relative concentrations, solubilities and condensation temperatures of the heteroatom compounds in each phase. The combination of temperatures and concentrations is such as to transfer the desired amount of these compounds to the liquid by absorption, condensation and equilibrium concentration differentials, to achieve the desired vapor purity. As is shown, in this embodiment the contacting liquid may comprise second stage liquid effluent that may or may not be cooled prior to contacting, by heat exchanger 28. It may also comprise contacting stage effluent that is recycled and cooled, by heat exchanger 28, to a temperature below that of the first stage vapor effluent in the contacting stage. It may also be a mixture of these two liquids, with or without cooling. Further, and as shown in FIG. 1, all or a portion of the condensed, hydrotreated liquid recovered from the contacting and second stage vapor effluents may be used as contacting liquid, either with or without first, second and/or contacting stage liquid effluent. The contacting liquid, now containing more of these impurities than before it contacted the first stage vapor effluent, passes down into the separating and disengaging zone 22, in which it mixes with the first stage liquid effluent, with which it is passed into the second reaction stage. At the same time, fresh hydrogen or a hydrogen treat gas is passed into the top of the second stage via lines 40, 48 and 46. In the second reaction stage, the hydrocarbon liquid and hydrogen both pass cocurrently down through catalyst bed 18. During the second stage reaction, most of the remaining feed heteratom compounds, which are now sulfur and nitrogen compounds, are removed from the liquid, with the sulfur and nitrogen forming $H_2S$ and $NH_3$. The $H_2S$ and $NH_3$ pass into the second stage vapor. Both the contacting and second stage vapor effluents contain $C_{4+}$–$C_{5+}$ hydrocarbon vapors and normally gaseous $C_{4-}$–$C_{5-}$ hydrocarbons. The heteroatom reduced hydrocarbon liquid and heteroatom containing vapor both pass down through to the bottom of vessel 18, from which they are removed together, via line 50, and combine with the heteroatom reduced first reaction stage vapor removed from vessel 20, via line 52. The combined liquid and vapor effluent is then passed into heat exchanger 36, via line 54, and cooled to condense most of the heavier hydrocarbon components in the vapor, with the resulting vapor and liquid mixture then passed into the first, or hot separating zone 32 in vessel 30, via line 56. In zone 32, the vapor is disengaged and separated from the liquid, with the hydrotreated liquid removed via line 58 and sent to a product stripper. The vapor is removed from zone 32 via line 60 and passed through a second, or cold heat exchanger 38, in which it is further cooled down to condense out, as liquid, more hydrotreated hydrocarbons (e.g., $C_{4+}$–$C_{5+}$). The remaining vapor comprises mostly methane and hydrogen, along with most of the $H_2S$ and $NH_3$. The condensed hydrocarbons and vapor containing $H_2S$ and $NH_3$ are passed, via line 62 into cold separating zone 34 to separate them, with the liquid removed via line 64 and sent to the product striper. The remaining vapor is removed as tail gas via line 66, and sent to further processing for removal of the $H_2S$ and $NH_3$. Since either or both the first stage and second stage liquid effluent may be used as the contacting liquid for the contacting stage, the recycle lines for these streams are shown as dotted lines. Thus, line 68 is a tie-in point for recycling a slip stream of the liquid recovered from the bottom of vessel 20 and passed, via liquid pump 26, through heat exchanger 28, which cools it to a temperature sufficiently below that of the first stage vapor effluent, for the impurities to transfer from the vapor, into the contacting liquid. This cooled liquid is then passed, via line 29, back up into the top of vessel 20. Lines 70, 72 and 74 are shown as optional transfer and recycle lines, for passing hydrotreated, second stage liquid effluent and/or hydrotreated liquid recovered from the second and/or contacting stage vapors, back into pump 26, optional heat exchanger 28, line 29 and into the top of 20 as all or part of the contacting liquid.

Figure 2:
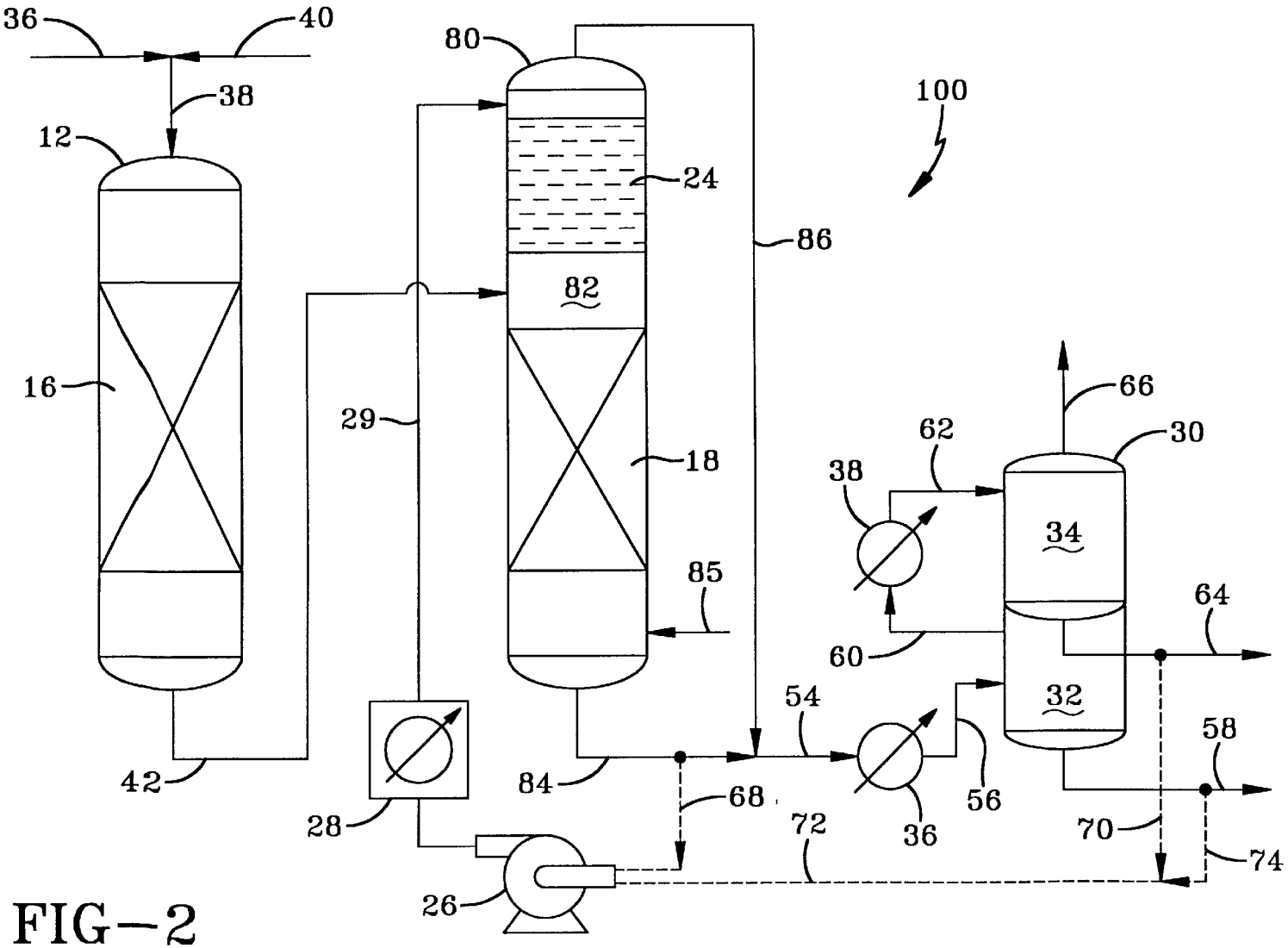
FIG. 2 is a simple schematic flow diagram of an embodiment of the invention with a cocurrent first reaction stage, a countercurrent second reaction stage, and with the contacting stage located in the second reaction stage vessel.

FIG. 2 schematically illustrates another embodiment of the process of the invention, in which both the liquid-vapor contacting stage and second hydrotreating reaction stages are located in the same vessel, with the first and second reaction stages being cocurrent gas and liquid flow and countercurrent gas and liquid flow stages, respectively. As is the case for the embodiment shown in FIG. 1, this embodiment will also be explained with particular reference to hydrotreating a heteroatom-containing fuel distillate fraction. Accordingly, the same vessels, heat exchangers, lines and pump shown in FIG. 1 and which have the same function, have the same numbers in both FIGS. 1 and 2. There are also substantial differences in the embodiment shown in FIG. 2, in that the first stage liquid effluent is not used as all or a part of the contacting liquid and, further, the combined first and second stage vapors are contacted with the liquid, in the contacting stage. Otherwise the process is similar to the embodiment shown in FIG. 1.

Referring to FIG. 2, in the hydrotreating unit 100, the feed is passed via lines 36 and 38 into the top of first reaction stage vessel 12. At the same time, fresh hydrogen or hydrogen-containing treat gas is passed into the vessel via lines 40 and 38. The feed and hydrogen pass cocurrently down through the catalyst bed 16, in which heteroatom compounds are removed and some components are saturated, as in the embodiment of FIG. 1. The heteroatom compounds are removed primarily by conversion to $H_2S$, $NH_3$ and water. This produces a first stage effluent comprising a partially hydrotreated liquid and vapor, wherein the vapor comprises partially hydrotreated and vaporized feed components, hydrogen, $H_2S$, $NH_3$ and lighter hydrocarbons (mostly methane). The liquid and vapor effluents pass down into the bottom of the vessel from which they are removed, via line 42, and passed into feed inlet and vapor space 82 in vessel 80. Vessel 80 contains both the liquid-vapor contacting means 24 for the contacting stage and a hydrotreating catalyst bed 18 below, for the second stage hydrotreating. The first stage liquid effluent passes down, and the hydrogen and vapor effluent pass up, through the second hydrotreating reaction stage, defined primarily by hydrotreating catalyst bed 18. Thus, the liquid and hydrogen flow countercurrently to each other in the second reaction stage. The second stage hydrotreated vapor effluent flows up from bed 18 and into contacting stage zone 24, in which it combines with the first stage vapor effluent. The combined first and second stage vapor effluents flow up through bed 24, in which they contact downflowing, hydrotreated, second stage liquid which enters above the bed, via line 29. As in the embodiment in FIG. 1, heteroatom compounds remaining in the combined vapors are removed by absorption, condensation and/or equilibrium differential transfer, to the downflowing liquid. The contacting stage vapor effluent, which now contains $H_2S$, $NH_3$ and substantially reduced in heteroatom feed components, is then passed into line 86, where it combines with the hydrotreated second stage liquid effluent from line 84. The contacting stage liquid effluent flows down 24 and into catalyst bed 18, in which it mixes with the downflowing first stage liquid effluent. Hydrogen or a hydrogen treat gas is passed up into the second stage hydrotreating zone via line 85 and reacts with the feed heteroatom compounds in the downflowing liquid, thereby removing them from the liquid by converting them primarily to $H_2S$ and $NH_3$. The hydrotreated second stage liquid effluent is removed via line 84, combines with the contacting stage vapor effluent, and the mixture is passed, via line 54, through a hot heat exchanger, etc., as is the case for the embodiment shown in FIG. 1. Hydrotreated contacting liquid may be derived from one or more of (i) the second stage liquid effluent and (ii) hydrotreated hydrocarbon vapor components that have been condensed to liquid and recovered. This is shown by the optional tie lines 70, 74, 72 and 68. As is the case for the embodiment shown in FIG. 1, the hydrotreated liquids in lines 58 and 64 will typically be sent to a stripper and the contacting liquid may also be derived from the stripped liquid.

Those skilled in the art will appreciate that the invention can be extended to more than two reaction and one contacting stages. Thus, one may also employ three or more reaction stages in which the partially processed liquid effluent from the first stage is the second stage feed, the second stage liquid effluent is the third stage feed, and so on, with attendant vapor stage contacting in one or more liquid-vapor contacting stages. By reaction stage is meant at least one catalytic reaction zone in which the liquid, or mixture of liquid and vapor reacts with hydrogen in the presence of a suitable hydroprocessing catalyst to produce an at least partially hydroprocessed effluent. The catalyst in a reaction zone can be in the form of a fixed bed, a fluidized bed or dispersed in a slurry liquid. More than one catalyst can also be employed in a particular zone as a mixture or in the form of layers (for a fixed bed). Further, where fixed beds are employed, more than one bed of the same or different catalyst may be used, so that there will be more than one reaction zone. The beds may be spaced apart with optional gas and liquid distribution means upstream of each bed, or one bed of two or more separate catalysts may be used in which each catalyst is in the form of a layer, with little or no spacing between the layers. The liquid will pass successively from one zone to the next.

The term "hydrotreating" as used herein refers to processes wherein a hydrogen-containing treat gas is used in the presence of a suitable catalyst which is primarily active for the removal of heteroatoms, such as sulfur, and nitrogen, non-aromatics saturation and, optionally, saturation of aromatics. Suitable hydrotreating catalysts for use in a hydrotreating embodiment of the invention include any conventional hydrotreating catalyst. Examples include catalysts comprising of at least one Group VIII metal catalytic component, preferably Fe, Co and Ni, more preferably Co and/or Ni, and most preferably Co; and at least one Group VI metal catalytic component, preferably Mo and W, more preferably Mo, on a high surface area support material, such as alumina. Other suitable hydrotreating catalysts include zeolitic catalysts, as well as noble metal catalysts where the noble metal is selected from Pd and Pt. The Groups referred to herein are those found in the Periodic Table of the Elements, copyrighted in 1968 by the Sargent-Welch Scientific Company. As mentioned above, it is within the scope of the present invention that more than one type of hydrotreating catalyst may be used in the same reaction stage or zone. Typical hydrotreating temperatures range from about 100° C. to about 400° C. with pressures from about 50 psig to about 3,000 psig, preferably from about 50 psig to about 2,500 psig. If one of the reaction stages is a hydrocracking stage, the catalyst can be any suitable conventional hydrocracking catalyst run at typical hydrocracking conditions. Typical hydrocracking catalysts are described in U.S. Pat. No. 4,921,595 to UOP, which is incorporated herein by reference. Such catalysts are typically comprised of a Group VIII metal hydrogenating component on a zeolite cracking base. Hydrocracking conditions include temperatures from about 200° to 425° C.; a pressure of about 200 psig to about 3,000 psig; and liquid hourly space velocity from about 0.5 to 10 V/V/Hr, preferably from about 1 to 5 V/V/Hr. Non-limiting examples of aromatic hydrogenation catalysts include nickel, cobalt-molybdenum, nickel-molybdenum, and nickel-tungsten. Noble metal (e.g., platinum and/or palladium) containing catalysts can also be used. The aromatic saturation zone is preferably operated at a temperature from about 40° C. to about 400° C., more preferably from about 260° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 2 V/V/Hr.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A hydroprocessing process for removing at least one impurity from a hydrocarbonaceous feed which comprises the steps of:

(a) reacting said feed with hydrogen in a first hydroprocessing reaction stage in the presence of a hydroprocessing catalyst to form a first stage effluent having a lower impurity content than said feed, said effluent comprising a first stage hydroprocessed hydrocarbonaceous liquid and a vapor which contains hydroprocessed hydrocarbonaceous feed components, wherein both said liquid and vapor effluents contain said impurities, with said impurities in equilibrium between said liquid and vapor effluents;

(b) separating said first stage liquid and vapor effluents;

(c) contacting said vapor effluent, in a contacting stage, with a hydrocarbonaceous liquid, under conditions such that impurities in said vapor transfer to said liquid, to form a contacting stage effluent comprising a hydrocarbonaceous liquid of increased impurity content and a vapor comprising hydroprocessed hydrocarbonaceous feed components having an impurity content less than that of said first stage vapor effluent, and (d) reacting said first and contacting stage liquid effluents with hydrogen in a second hydroprocessing reaction stage, in the presence of a hydroprocessing catalyst, to form a second stage effluent comprising a hydroprocessed hydrocarbonaceous liquid and a vapor comprising hydroprocessed hydrocarbonaceous feed components, wherein said liquid has an impurity content lower than that in said feed and first stage liquid effluent.

2. A process according to claim 1 wherein said second reaction stage liquid effluent comprises product liquid.

3. A process according to claim 2 wherein said first and second reaction stage catalysts are the same or different.

4. A process according to claim 3 wherein said feed and hydrogen flow cocurrently through said first reaction stage.

5. A process according to claim 4 wherein at least one of said contacting and second stage vapor effluents is cooled to condense and recover said vaporized hydroprocessed hydrocarbonaceous feed components as hydroprocessed liquid, having an impurity content lower than that of said feed and first stage liquid effluents.

6. A process according to claim 5 wherein said contacting liquid comprises at least one of said (i) first reaction stage liquid effluent, (ii) second reaction stage liquid effluent, (iii) condensed hydrocarbonaceous feed vapor components having an impurity level lower than that of said feed, or mixture thereof.

7. A process according to claim 6 wherein said condensed hydrocarbonaceous feed component liquid having an impurity content lower than that of said feed and first stage liquid effluents, is obtained from both said contacting and second stage vapor effluents.

8. A process according to claim 6 wherein said contacting liquid is cooled to a temperature lower than said vapor in said contacting zone prior to said contacting.

9. A process according to claim 8 wherein said transfer conditions include said contacting liquid having an impurity content no greater than that of said first reaction stage liquid effluent.

10. A process according to claim 6 wherein said liquid and hydrogen flow countercurrently through said second reaction stage.

11. A process according to claim 10 wherein said condensed hydrocarbonaceous liquid having an impurity level lower than that of said feed and first stage liquid effluent, is obtained from said contacting stage vapor effluent.

12. A process according to claim 11 wherein said contacting liquid is cooled to a temperature lower than said vapor in said contacting zone prior to said contacting.

13. A process according to claim 12 wherein said transfer conditions include said contacting liquid having an impurity content no greater than that of said first reaction stage liquid effluent.

14. A process for hydrotreating a hydrocarbon feed which contains impurities comprising feed heteroatom compounds and unsaturates, said process comprising the steps of:

(a) reacting said feed with hydrogen in a first hydrotreating reaction stage in the presence of a hydrotreating catalyst to form a first stage effluent having a lower impurity content than said feed, said effluent comprising a first stage hydrotreated hydrocarbon liquid and a vapor which contains hydrotreated hydrocarbon feed components, wherein both said liquid and vapor effluents contain said impurities, with said impurities in equilibrium between said liquid and vapor effluents;

(b) separating said first stage liquid and vapor effluents;

(c) contacting said vapor effluent, in a contacting stage, with a hydrocarbon liquid under conditions such that impurities in said vapor transfer to said liquid, to form a contacting stage effluent comprising a hydrocarbon liquid of increased impurity content and a vapor comprising hydrotreated hydrocarbon feed components having an impurity content less than that in said first stage vapor effluent, and (d) reacting said first and contacting stage liquid effluents with hydrogen in a second hydrotreating reaction stage, in the presence of a hydrotreating catalyst, to form a second stage effluent comprising a hydrotreated hydrocarbon liquid and a vapor comprising hydrotreated hydrocarbon feed components, wherein said liquid has an impurity content lower than that in said feed and first stage liquid effluent.

15. A process according to claim 14 wherein said second reaction stage liquid effluent comprises hydrotreated product liquid.

16. A process according to claim 15 wherein said feed and hydrogen flow cocurrently through said first reaction stage.

17. A process according to claim 16 wherein additional product liquid is obtained by condensing hydrotreated vapor effluent from at least one of said contacting and second reaction stages.

18. A process according to claim 17 wherein said first and second stage hydrotreating catalysts are the same or different.

19. A process according to claim 18 wherein at least one of said contacting and second stage vapor effluents is cooled to condense and recover said vaporized hydrotreated hydrocarbon feed components as hydrotreated liquid, having an impurity content lower than that of said feed and first stage liquid effluents.

20. A process according to claim 19 wherein said contacting liquid comprises at least one of said (i) first reaction stage liquid effluent, (ii) second reaction stage liquid effluent, (iii) condensed hydrocarbon feed vapor components having an impurity level lower than that of said feed, or mixture thereof.

21. A process according to claim 20 wherein said condensed hydrocarbon feed component liquid having an impurity content lower than that of said feed and first stage liquid effluents, is obtained from both said contacting and second stage vapor effluents.

22. A process according to claim 20 wherein said contacting liquid is cooled to a temperature lower than said vapor in said contacting zone prior to said contacting.

23. A process according to claim 20 wherein said transfer conditions include said contacting liquid having an impurity content no greater than that of said first reaction stage liquid effluent.

24. A process according to claim 20 wherein said liquid and hydrogen flow countercurrently through said second reaction stage.

25. A process according to claim 24 wherein said condensed hydrocarbonaceous feed component liquid having an impurity level lower than that of said feed and first stage liquid effluent is obtained from said contacting stage vapor effluent.

26. A process according to claim 25 wherein said contacting liquid is cooled to a temperature lower than said vapor in said contacting zone prior to said contacting.

27. A process according to claim 26 wherein said transfer conditions include said contacting liquid having an impurity content no greater than that of said first reaction stage liquid effluent.

28. A hydroprocessing process for removing at least one impurity from a hydrocarbonaceous feed which comprises the steps of:

(a) reacting said feed with hydrogen in a first hydroprocessing reaction stage in the presence of a hydroprocessing catalyst to form a first stage effluent comprising a first stage hydroprocessed hydrocarbonaceous liquid and a vapor which contains hydroprocessed hydrocarbonaceous feed components, wherein both said liquid and vapor effluents contain said impurities, with said impurities in equilibrium between said liquid and vapor effluents;

(b) separating said first stage liquid and vapor effluents;

(c) contacting said vapor effluent, in a contacting stage, with a hydrocarbonaceous liquid, under conditions such that impurities in said vapor transfer to said liquid, to form a contacting stage effluent comprising a hydrocarbonaceoous liquid of increased impurity content and a vapor comprising hydroprocessed hydrocarbonaceous feed components, and (d) reacting said first and contacting stage liquid effluents with hydrogen in a second hydroprocessing reaction stage, in the presence of a hydroprocessing catalyst, to form a second stage effluent comprising a hydroprocessed hydrocarbonaceoous liquid and a vapor comprising hydroprocessed hydrocarbonaceous feed components.

* * * * *